US011698227B2

(12) United States Patent
Chang et al.

(10) Patent No.: US 11,698,227 B2
(45) Date of Patent: Jul. 11, 2023

(54) EDDY FLUID HEAT EXCHANGE DEVICE

(71) Applicants: Hung-Sen Chang, Kaohsiung (TW); Yu-Chieh Chang, Kaohsiung (TW)

(72) Inventors: Hung-Sen Chang, Kaohsiung (TW); Yu-Chieh Chang, Kaohsiung (TW)

( * ) Notice: Subject to any disclaimer, the term of this patent is extended or adjusted under 35 U.S.C. 154(b) by 0 days.

(21) Appl. No.: 17/459,419

(22) Filed: Aug. 27, 2021

(65) Prior Publication Data

US 2023/0013985 A1 Jan. 19, 2023

(30) Foreign Application Priority Data

Jul. 13, 2021 (TW) ..... 110125687

(51) Int. Cl.

| | |
|---|---|
| ***F28F 13/12*** | (2006.01) |
| ***F28D 7/16*** | (2006.01) |
| ***F28F 1/36*** | (2006.01) |
| ***F28F 13/02*** | (2006.01) |
| *F28D 7/10* | (2006.01) |

(52) U.S. Cl.
CPC ..... *F28D 7/1607* (2013.01); *F28F 1/36* (2013.01); *F28F 13/02* (2013.01); *F28F 13/12* (2013.01); *F28D 7/106* (2013.01)

(58) Field of Classification Search
CPC ..... F28F 13/12; F28F 13/125; F28F 1/40
See application file for complete search history.

(56) References Cited

U.S. PATENT DOCUMENTS

| | | | | |
|---|---|---|---|---|
| 2,091,119 | A * | 8/1937 | Saint-Jacques | F28D 7/022 165/140 |
| 2007/0029066 | A1 | 2/2007 | Kidwell et al. | |
| 2007/0143914 | A1 | 6/2007 | Shirai et al. | |

FOREIGN PATENT DOCUMENTS

| | | | |
|---|---|---|---|
| CA | 606152 | A | 10/1960 |
| CN | 107764099 | A | 3/2018 |
| CN | 111707113 | A | 9/2020 |
| CN | 213748012 | U | 7/2021 |
| EP | 2420790 | A2 | 2/2012 |
| EP | 3715763 | A1 | 9/2020 |
| GB | 759440 | A | 10/1956 |
| GB | 2312276 | A | 10/1997 |

(Continued)

OTHER PUBLICATIONS

Office Action for Taiwan Patent Application No. 110125687, dated Jan. 14, 2022, 6 pages.

*Primary Examiner* — Eric S Ruppert

(74) *Attorney, Agent, or Firm* — Withrow & Terranova, P.L.L.C.; Vincent K. Gustafson

(57) ABSTRACT

An eddy fluid heat exchange device comprises a compound tube assembly mounted with an eddy guiding structure. The compound tube assembly comprises an outer tube mounted with an inner tube. The outer tube and the inner tube have an eddy passage along an axis of the inner tube formed therebetween. The outer tube has a guiding exit at one end of the eddy passage. The eddy guiding structure is mounted at another end of the eddy passage, having a guiding entrance. Entering from the guiding entrance, high pressure fluid forms eddies surrounding the inner tube when flowing through the eddy guiding structure. A flowing path of the high pressure fluid in the eddy passage extends, simplifying structures and lowering costs of production and maintenance. Besides, increasing a heat transfer area between the high pressure fluid and the outer tube or the inner tube improves the heat transfer efficiency.

17 Claims, 21 Drawing Sheets

(56) References Cited

FOREIGN PATENT DOCUMENTS

| | | | | |
|---|---|---|---|---|
| KR | 20130001544 | A | | 1/2013 |
| RU | 19347 | U1 | * | 8/2001 |
| TW | 179944 | | | 3/1992 |
| TW | 255009 | B | | 8/1995 |
| TW | 562854 | B | | 11/2003 |
| TW | I763557 | B | | 5/2022 |
| WO | 2015043548 | A1 | | 4/2015 |

* cited by examiner

EDDY FLUID HEAT EXCHANGE DEVICE

BACKGROUND OF THE INVENTION

1. Field of the Invention

The present invention relates to a heat exchange device, especially to a heat exchange device that exchanges heat through eddying fluid.

2. Description of the Prior Arts

A heat exchanger transfers heat between liquids to raise or lower temperatures of the liquids through flowing of the liquids. A heat exchanger nowadays has a casing, a heated tube, and a cooled tube. The heated tube and the cooled tube are mounted circuitously inside the casing and are intersected and unconnected. Hot fluid flows through the heated tube of the exchanger. Cool fluid flows through the cooled tube.

In a heat exchanging process, when the hot fluid runs through the heated tube and the cool fluid runs through the cooled tube, the hot fluid and the cool fluid transfer heat through a wall of the heated tube and a wall of the cooled tube. By circuitous designs of the heated tube and the cooled tube, when the hot fluid and the cool fluid run through, a heat transfer area between the hot fluid and the cool fluid is increased, improving heat transfer efficiency.

Circuitous tubes design is necessary for the heat exchanger nowadays to improve the heat transfer efficiency. However, the circuitous tubes design has a complex structure, causing high costs of production and maintenance. Thus, the heat exchanger nowadays needs to be improved.

SUMMARY OF THE INVENTION

The present invention is to resolve the drawback that a heat exchanger nowadays has a complex structure, causing high costs of production and maintenance.

An eddy fluid heat exchange device of the present invention comprises a compound tube assembly and an eddy guiding structure. The compound tube assembly comprises an outer tube, an inner tube mounted in the outer tube, and an eddy passage formed between the outer tube and the inner tube. The eddy passage extends along an axis of the inner tube. The outer tube has a guiding exit formed at an end of the eddy passage. The eddy guiding structure is mounted at the compound tube assembly and disposed at another end, which is opposite to the guiding exit, of the eddy passage. The eddy guiding structure has a guiding entrance connected to the eddy passage. A high pressure fluid is fed into the guiding entrance. After passing through the eddy guiding structure, the high pressure fluid eddies and enters the eddy passage. The high pressure fluid is discharged from the guiding exit after exchanging heat with the inner tube or the outer tube.

The present invention is connected to a high pressure fluid source by the guiding entrance, having advantages below:

1. Simplified structure and lower cost: By passage designs of the compound tube assembly and the eddy guiding structure, when flowing through the eddy guiding structure, the high pressure fluid forms eddies surrounding the inner tube to extend a flowing path in the eddy passage. Thus, complex circuitous passages are unnecessary for the present invention, simplifying structures and lowing the costs of production and maintenance.

2. Improved heat transfer efficiency: As above mentioned, with the eddy guiding structure guiding the high pressure fluid eddies to pass through the eddy passage, the flowing path of the high pressure fluid in the eddy passage extends, increasing a heat transfer area between the high pressure fluid and the outer tube or the inner tube, and improving the heat transfer efficiency.

DETAILED DESCRIPTION OF THE PREFERRED EMBODIMENTS

FIGS. 1, 5, 8 and 13 are embodiments of an eddy fluid heat exchange device in accordance with the present invention. The eddy fluid heat exchange device comprises a compound tube assembly 10*a*, 10*b* and an eddy guiding structure 20*a*, 20*b*.

Figure 11:
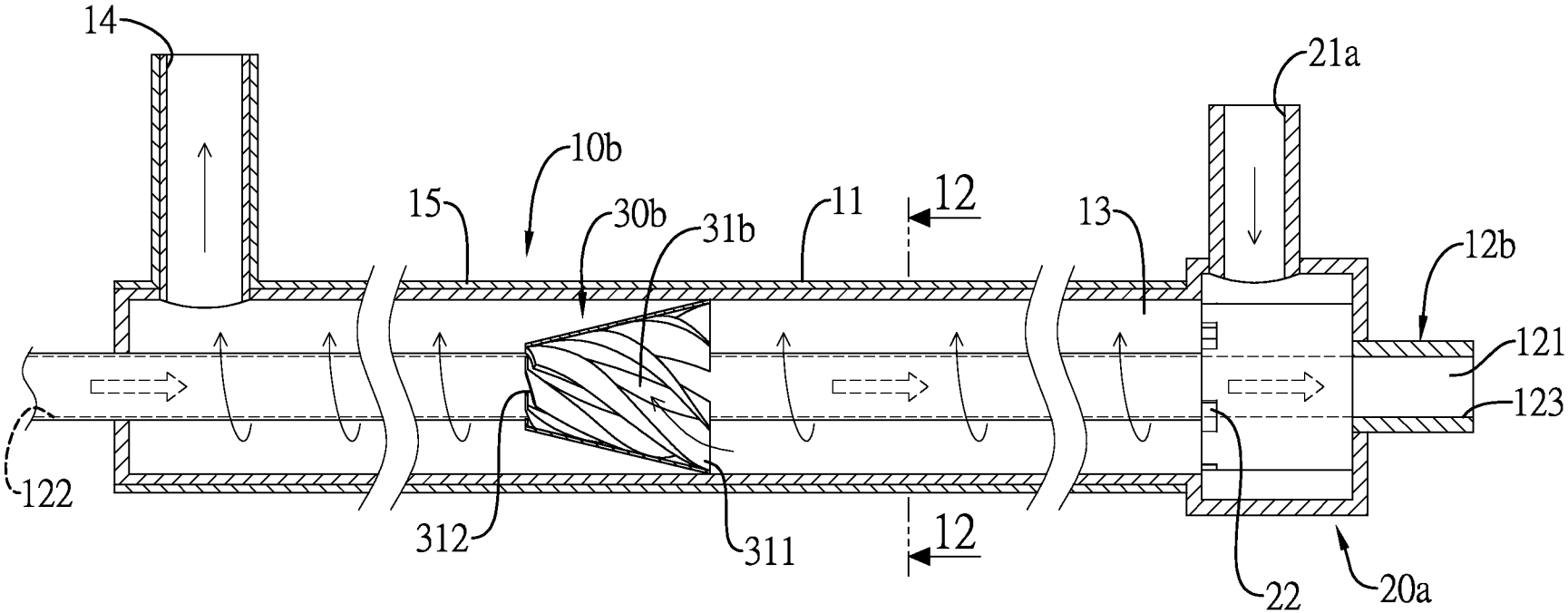
FIG. 11 is a side view of the third embodiment of the eddy fluid heat exchange device in FIG. 8.
Figure 12:
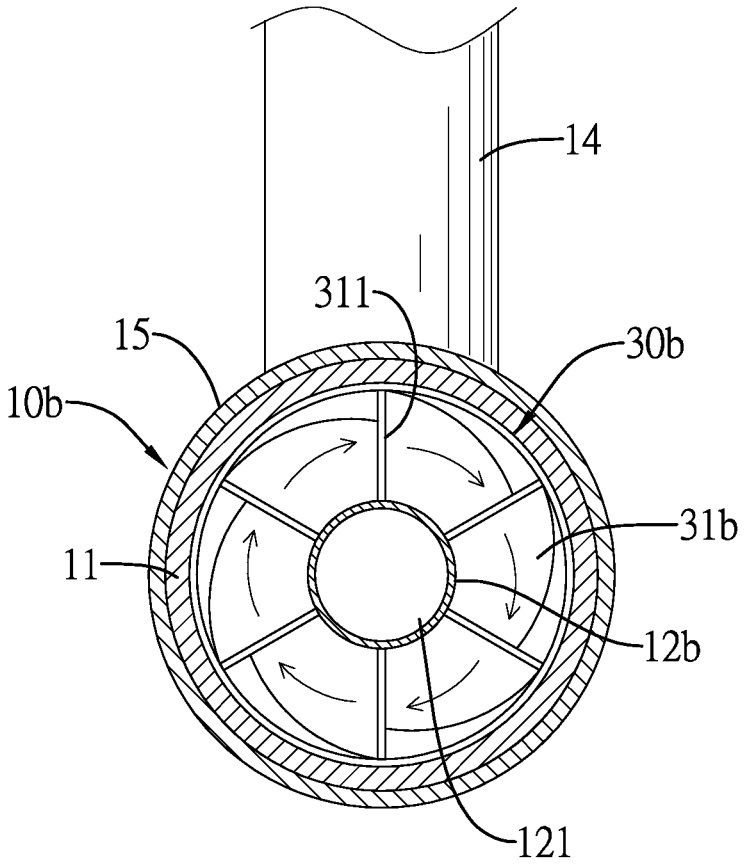
FIG. 12 is a partial sectional view across line 12-12 in FIG. 11.

With reference to FIGS. 1, 2, 5, 8, 9, and 13, the compound tube assembly 10*a*, 10*b* comprises an outer tube 11, an inner tube 12*a*, 12*b* mounted in the outer tube 11, and an eddy passage 13 formed between the outer tube 11 and the inner tube 12*a*, 12*b*. The eddy passage 13 extends along an axis of the inner tube 12*a*, 12*b*. The outer tube 11 has a guiding exit 14 formed at an end of the eddy passage 13. In addition, with reference to FIGS. 3 and 6, two opposite ends of the inner tube 12*a*, 12*b* are closed. Alternatively, with reference to FIGS. 11 and 14, an outer side of the outer tube 11 is covered by an insulation layer 15. The inner tube 12*a*, 12*b* has a fluid passage 121 formed inside. The fluid passage 121 has a fluid inlet 122 and a fluid outlet 123. A working fluid is fed into the fluid passage 121 from the fluid inlet 122 to exchange heat with a high pressure fluid, and is discharged from the fluid outlet 123.

With reference to FIGS. 1, 4, 7, 8, 10, and 15, the eddy guiding structure 20*a*, 20*b* is mounted at the compound tube assembly 10*a*, 10*b* and disposed at another end, which is opposite to the guiding exit 14, of the eddy passage 13. The eddy guiding structure 20*a*, 20*b* has a guiding entrance 21*a*, 21*b* connected to the eddy passage 13. The high pressure fluid is fed into the guiding entrance 21*a*, 21*b*. After passing through the eddy guiding structure 20*a*, 20*b*, the high pressure fluid forms eddies and enters the eddy passage 13. The high pressure fluid is discharged from the guiding exit 14 after exchanging heat with the inner tube 12*a*, 12*b* or the outer tube 11.

Figure 7:
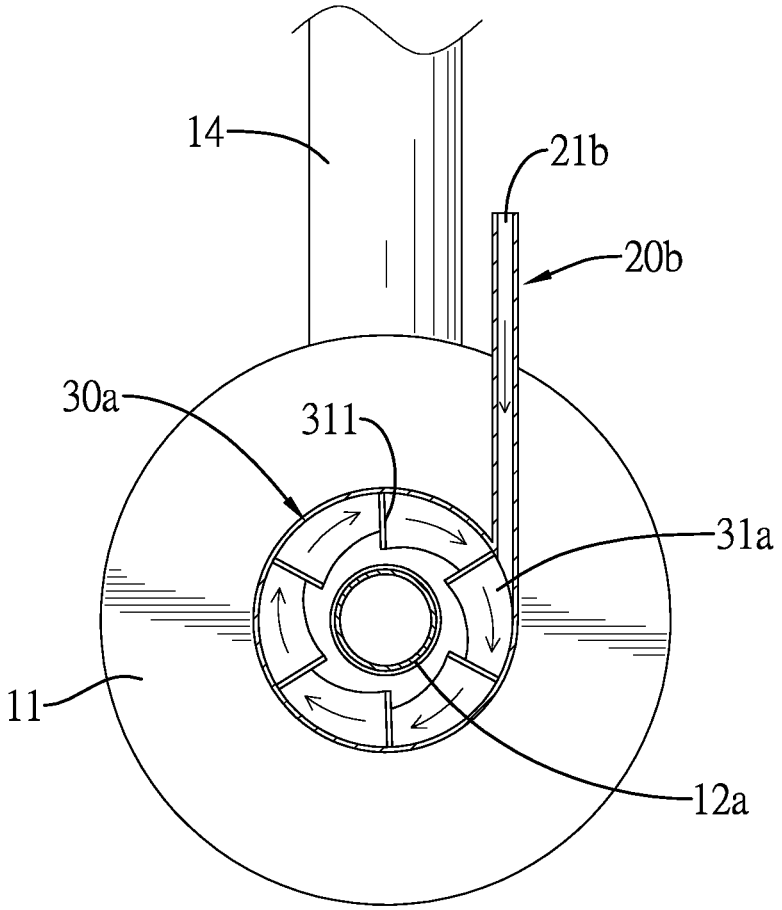
FIG. 7 is a partial sectional view across line 7-7 in FIG. 6.
Figure 15:
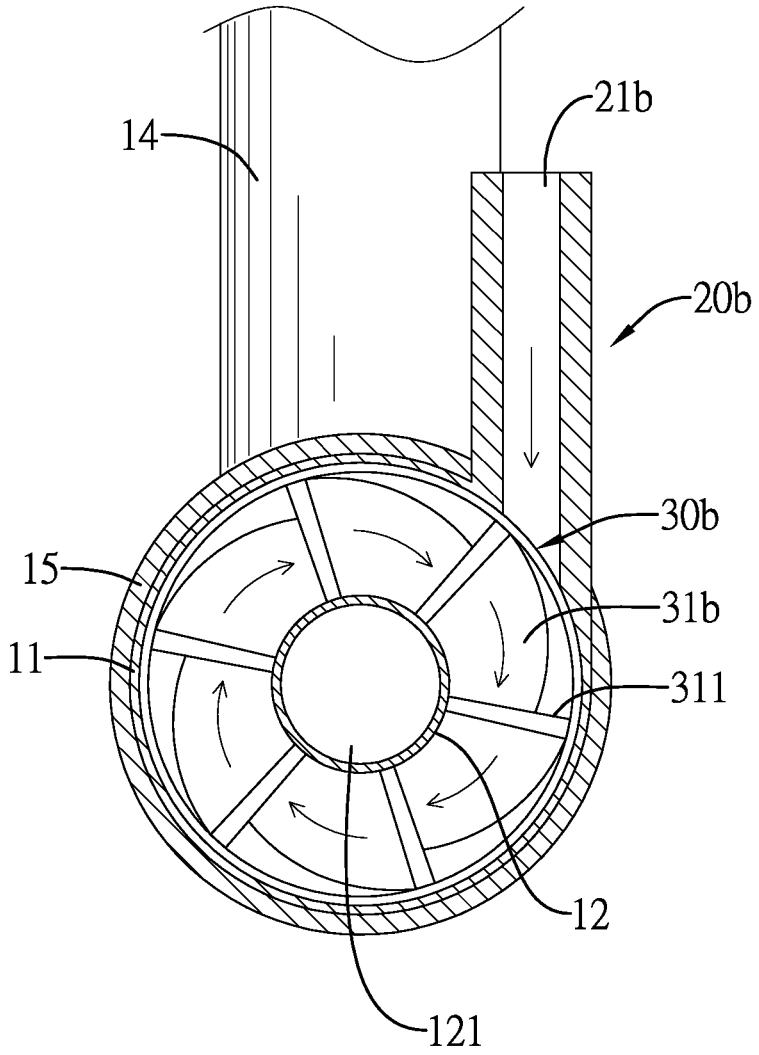
FIG. 15 is a partial sectional view across line 15-15 in FIG. 14.

The eddy guiding structure 20*a*, 20*b* has multiple embodiments. As shown in FIGS. 1, 4, 8 and 10, the eddy guiding structure 20*a* has multiple spiral guiding channels 22. One end of each one of the guiding channels 22 is connected to the eddy passage 13, and another end of each one of the guiding channels 22 is connected to the guiding entrance 21*a*. The high pressure fluid eddies when passing through the guiding channels 22. Alternatively, as shown in FIGS. 7 and 15, the guiding entrance 21*b* of the eddy guiding structure 20*b* extends along a tangent of the eddy passage 13. The high pressure fluid flows into the eddy passage 13 tangentially through the guiding entrance 21*b*, flowing along a wall of the outer tube 11 and forming eddies.

Besides, with reference to FIGS. 2, 3, 6, 10, 11, and 14, the present invention comprises at least one eddy deflecting structure 30*a*, 30*b*, depending on demand. The at least one eddy deflecting structure 30*a*, 30*b* is mounted in the eddy passage 13 of the compound tube assembly 10*a*, 10*b* and spaced apart from the eddy guiding structure 20*a*, 20*b*. The at least one eddy deflecting structure 30*a*, 30*b* has multiple spiral deflecting channels 31*a*, 31*b* annularly disposed apart from each other, defined between vanes annularly mounted to a sleeve that is conic in shape. Two ends of each one of the multiple spiral deflecting channels 31*a*, 31*b* are respectively an inlet end 311 and an outlet end 312. The inlet end 311 and the outlet end 312 both are respectively connected to the eddy passage 13. The at least one eddy deflecting structure 30*a*, 30*b* includes the vanes mounted to a conic sleeve, such that a bore of each one of the multiple deflecting channels 31*a*, 31*b* gradually reduces in size from the inlet end 311 to the outlet end 312. The high pressure fluid eddies when passing through the multiple deflecting channels 31*a*, 31*b*.

Figure 1:
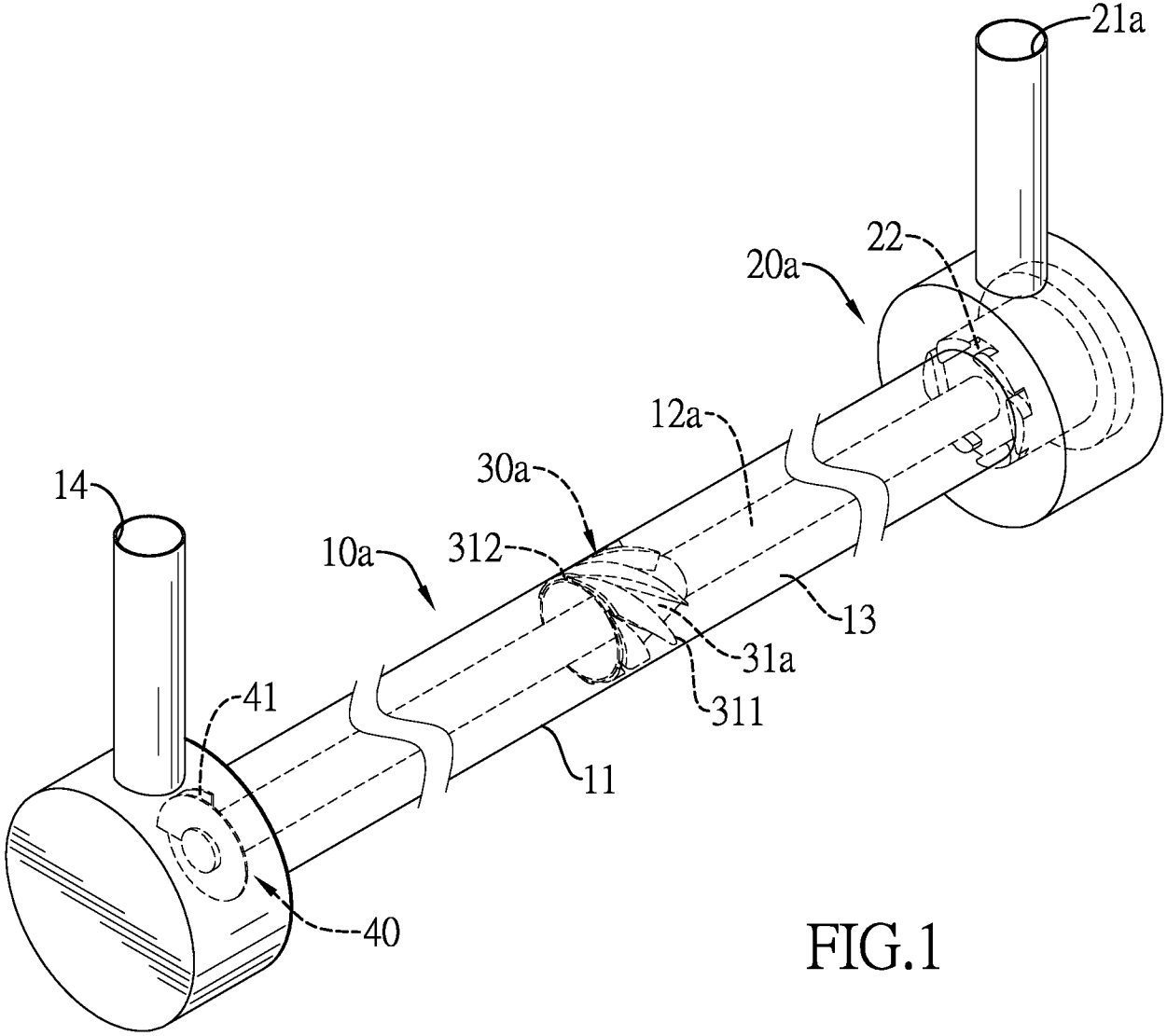
FIG. 1 is a perspective view of a first embodiment of an eddy fluid heat exchange device in accordance with the present invention.
Figure 2:
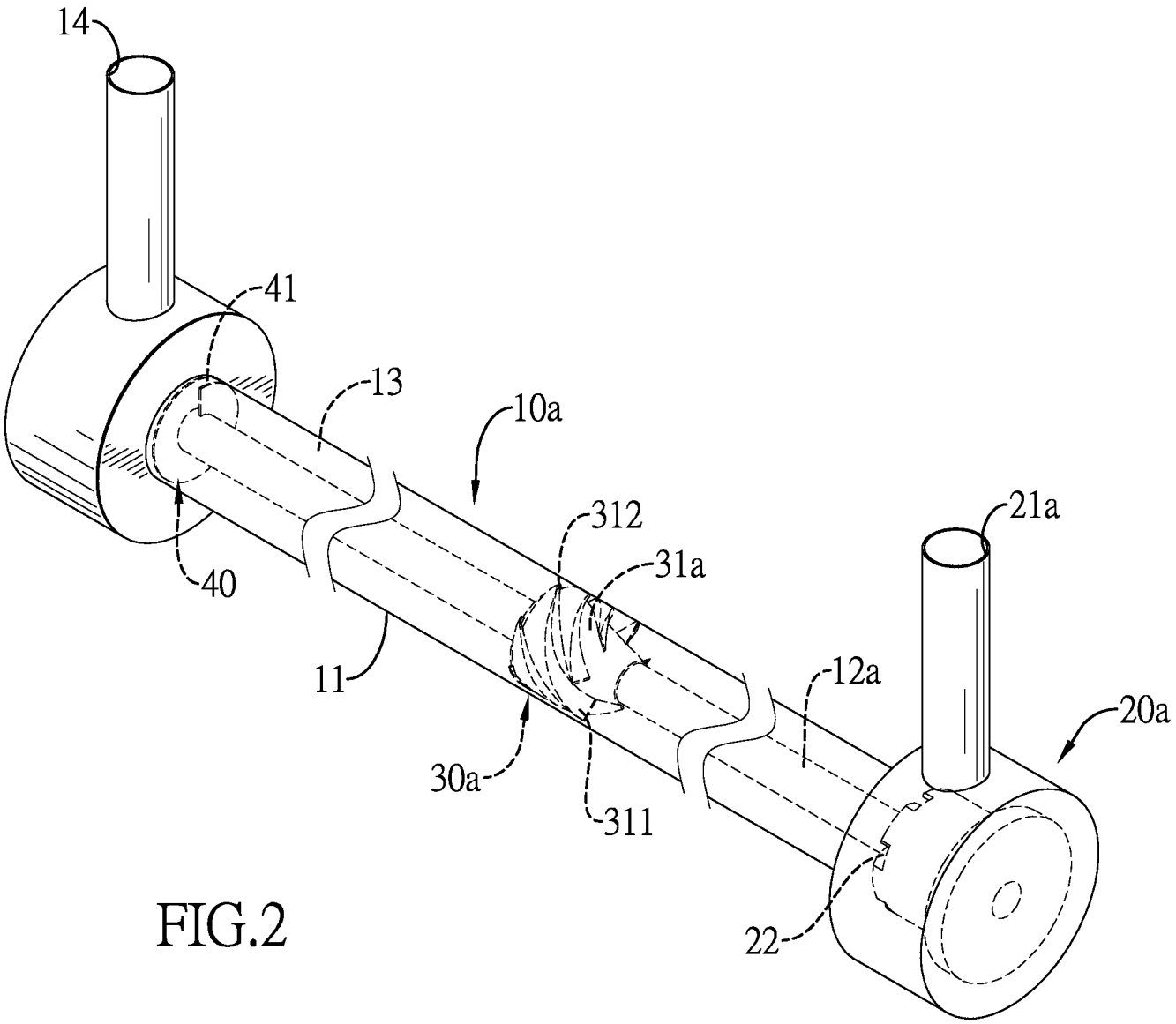
FIG. 2 is another perspective view of the first embodiment of the eddy fluid heat exchange device in FIG. 1.
Figure 3:
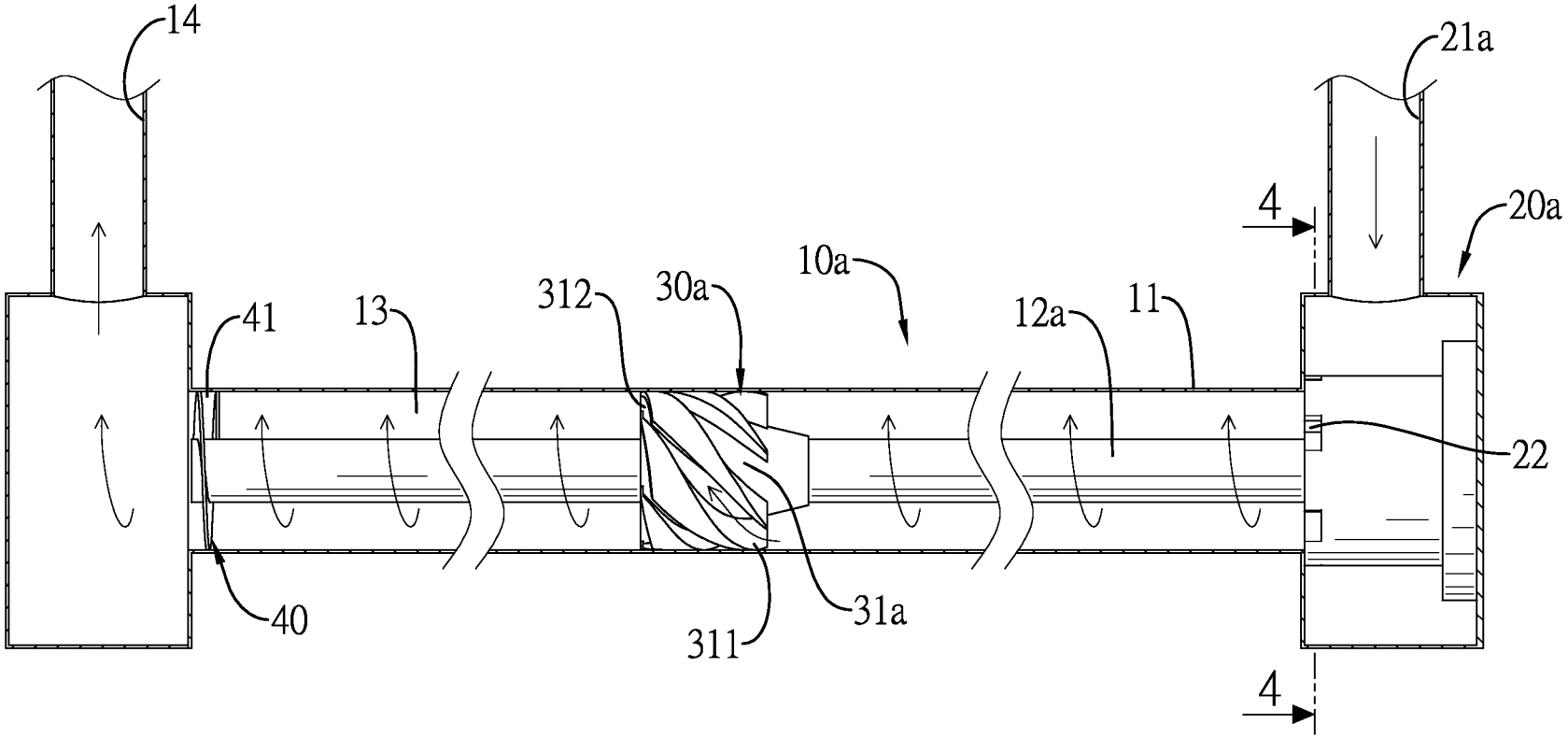
FIG. 3 is a side view of the first embodiment of the eddy fluid heat exchange device in FIG. 1.
Figure 4:
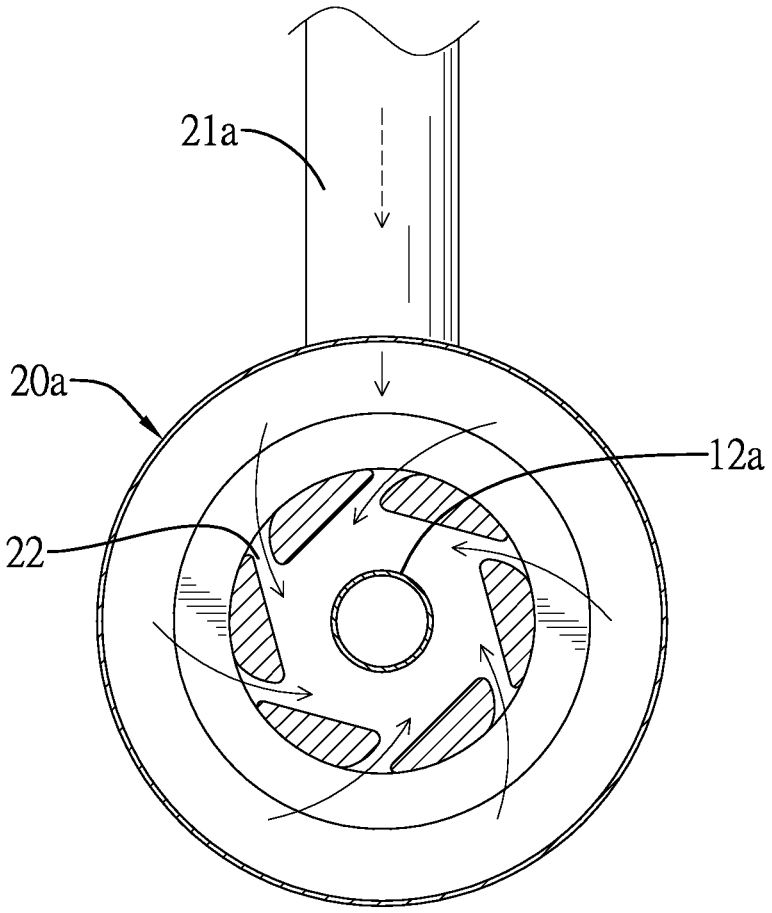
FIG. 4 is a partial sectional view across line 4-4 in FIG. 3.

Furthermore, with reference to FIGS. 2 and 3, the present invention comprises a diversion plate 40 mounted in the eddy passage 13 of the compound tube assembly 10*a*, disposed adjacent to the guiding exit 14 of the outer tube 11. The diversion plate 40 has a spiral channel 41, connected to the eddy passage 13, formed inside. The spiral channel 41 guides the high pressure fluid out from the guiding exit 14.

With reference to FIGS. 2, 3, 6, 10, 11 and 14, the guiding entrance 21*a*, 21*b* of the eddy guiding structure 20*a*, 20*b* is connected to a high pressure fluid source. By passage designs of the compound tube assembly 10*a*, 10*b* and the eddy guiding structure 20*a*, 20*b*, when flowing through the eddy guiding structure 20*a*, 20*b*, the high pressure fluid forms eddies surrounding the inner tube 12*a*, 12*b* in the eddy passage 13. Therefore, a flowing path of the high pressure fluid in the eddy passage 13 is extended. Thus, complex and circuitous passages are unnecessary for the present invention, simplifying structures and lowering costs of production and maintenance. Besides, the extended flowing path increases a heat transfer area between the high pressure fluid and the outer tube 11 or the inner tube 12*a*, 12*b* to improve the heat transfer efficiency.

In addition, the present invention can be adjusted into multiple embodiments depending on demand. The multiple embodiments of the present invention are described below.

With reference to FIGS. 1 to 4, in a first embodiment of the present invention, the two opposite ends of the inner tube 12*a* of the compound tube assembly 10*a* are closed. The eddy guiding structure 20*a* has the multiple spiral guiding channels 22. The high pressure fluid forms eddies when passing through the multiple spiral guiding channels 22, transferring heat with fluid outside the outer tube 11 while passing the eddy passage 13.

Figure 5:
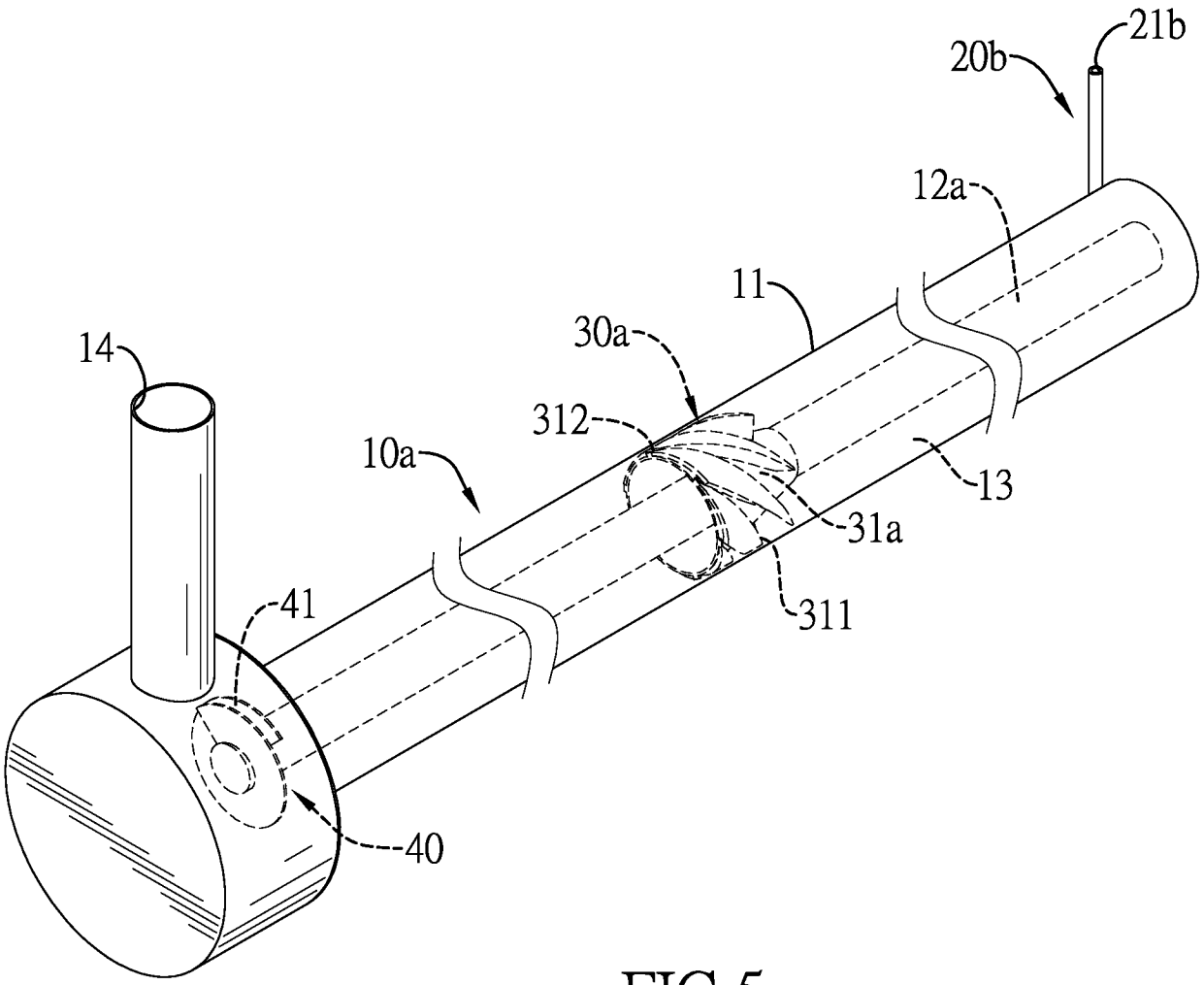
FIG. 5 is a perspective view of a second embodiment of the eddy fluid heat exchange device in accordance with the present invention.
Figure 6:
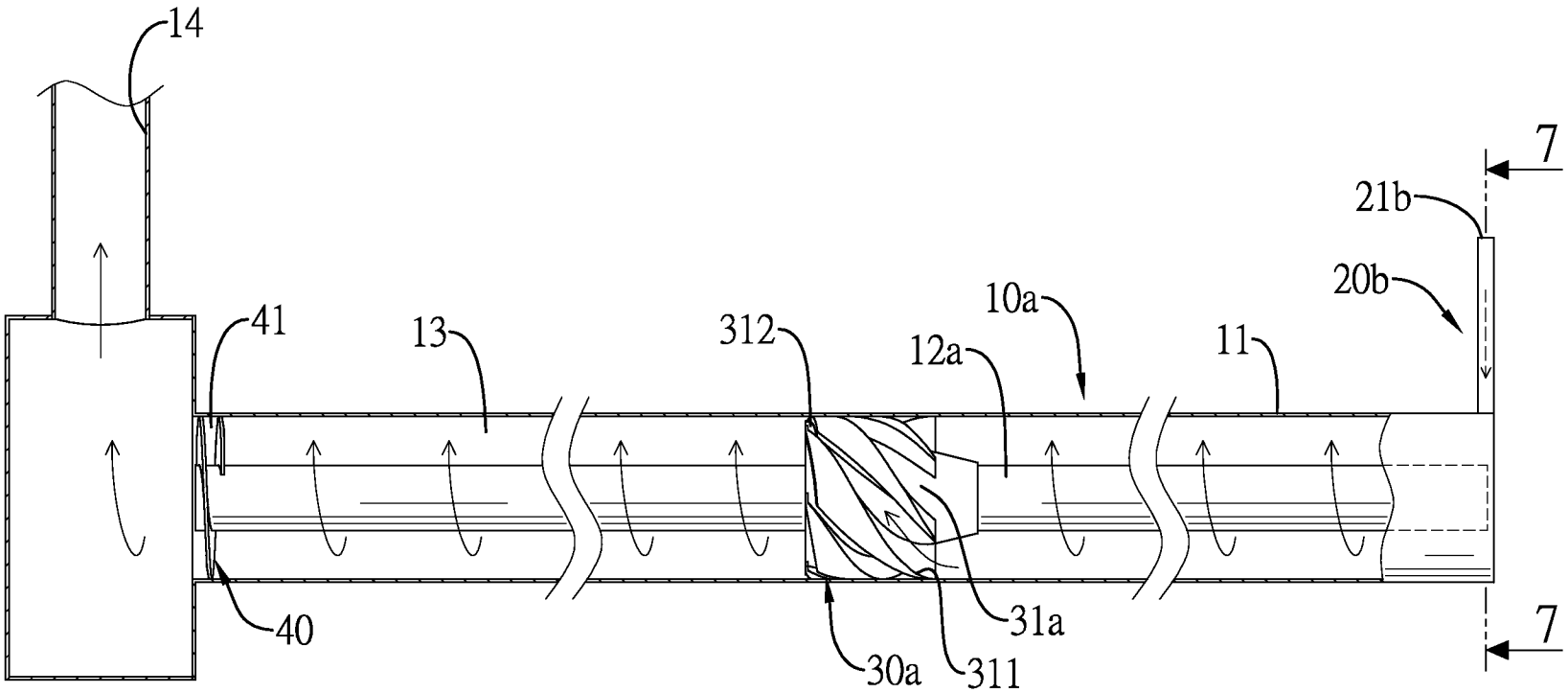
FIG. 6 is a side view of the second embodiment of the eddy fluid heat exchange device in FIG. 5.

With reference to FIGS. 5 to 7, in a second embodiment of the present invention, the two opposite ends of the inner tube 12*a* of the compound tube assembly 10*a* are closed. The guiding entrance 21*b* of the eddy guiding structure 20*b* extends along the tangent of the eddy passage 13. The high pressure fluid flows into the eddy passage 13 tangentially through the guiding entrance 21*b*, flowing along the wall of the outer tube 11 to eddy, transferring heat with the fluid outside the outer tube 11 while passing the eddy passage 13.

With reference to FIGS. 2, 3 and 6, the present invention comprises the at least one eddy deflecting structure 30*a* in the first and the second embodiments of the present invention. The outlet ends 312 of the multiple deflecting channels 31*a* of the at least one eddy deflecting structure 30*a* are disposed adjacent to an inner wall of the outer tube 11. The high pressure fluid flows along the multiple deflecting channels 31*a* adjacent to the inner wall of the outer tube 11 while passing through the at least one eddy deflecting structure 30*a* to improve the heat transfer efficiency between the high pressure fluid and the outer tube 11.

With reference to FIGS. 8 to 12, in a third embodiment of the present invention, the inner tube 12*b* of the compound tube assembly 10*b* has the fluid passage 121 formed inside. The outer side of the outer tube 11 is covered by the insulation layer 15. The working fluid is fed into the fluid passage 121 to exchange heat with the high pressure fluid, and then is discharged from the fluid outlet 123. The eddy guiding structure 20*a* has the multiple spiral guiding channels 22. The high pressure fluid eddies when passing through the multiple spiral guiding channels 22, transferring heat with the working fluid in the fluid passage 121 of the inner tube 12*b* while passing the eddy passage 13.

Figure 13:
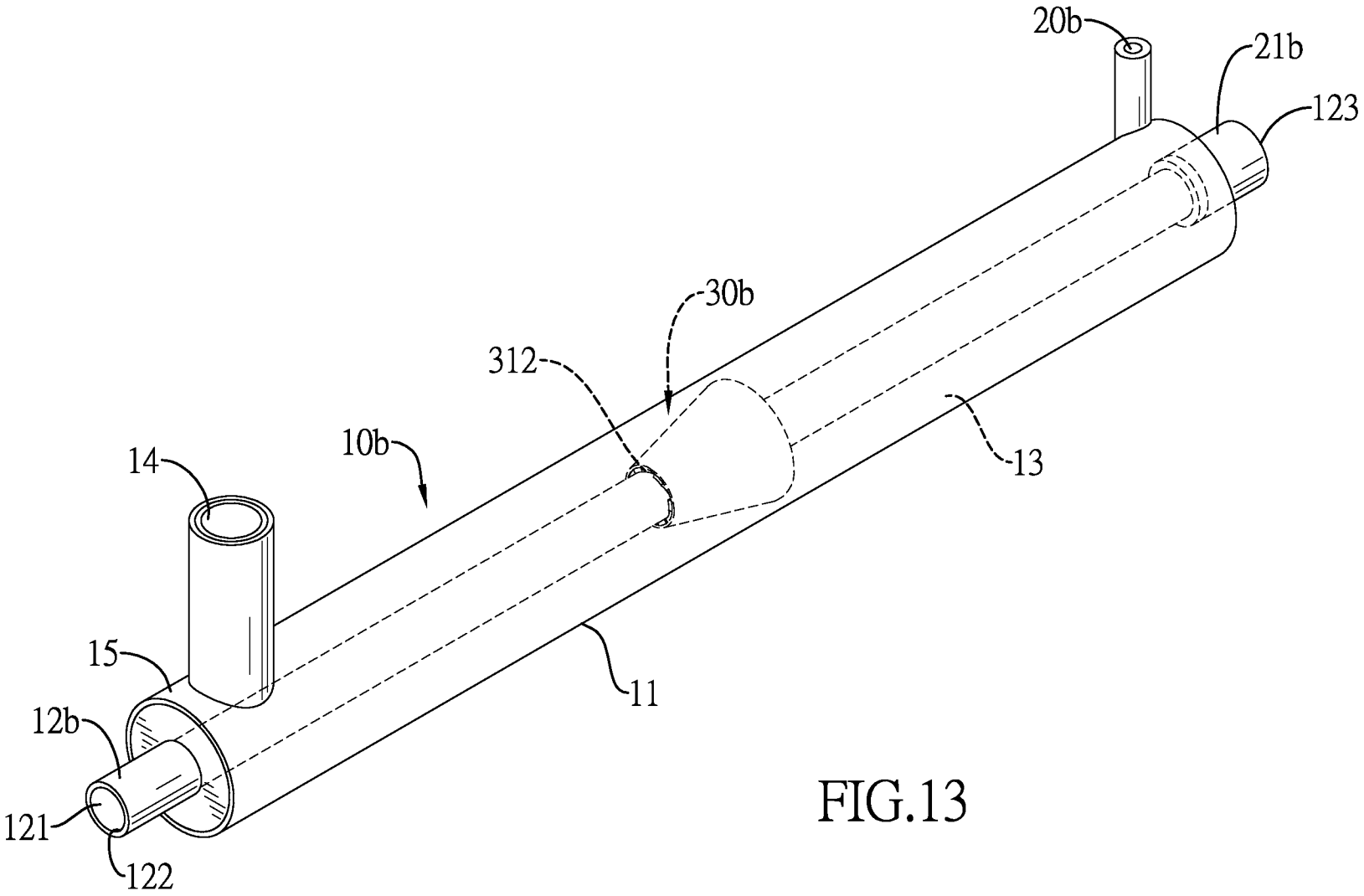
FIG. 13 is a perspective view of a fourth embodiment of the eddy fluid heat exchange device in accordance with the present invention.
Figure 14:
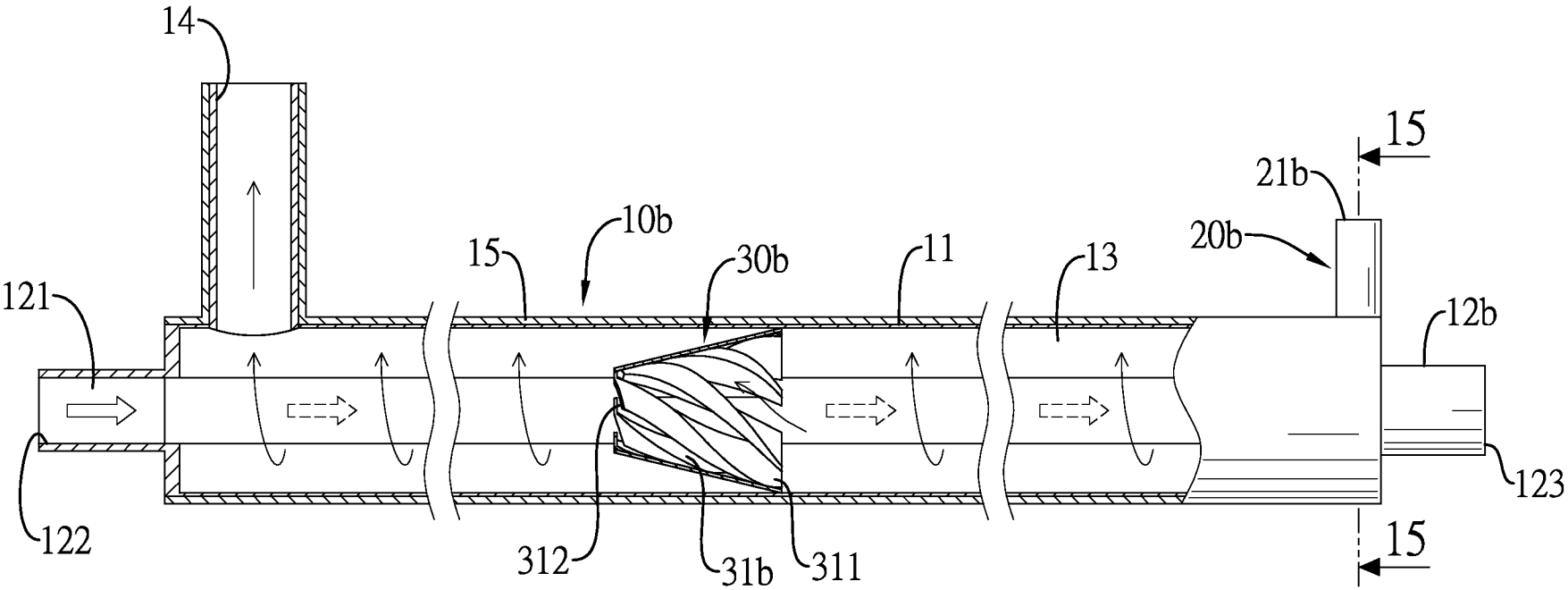
FIG. 14 is a side view of the fourth embodiment of the eddy fluid heat exchange device in FIG. 13.

With reference to FIGS. 13 to 15, in a fourth embodiment of the present invention, the inner tube 12*b* of the compound tube assembly 10*b* has the fluid passage 121 formed inside. The working fluid is fed into the fluid passage 121 to exchange heat with the high pressure fluid, and then is discharged from the fluid outlet 123. The guiding entrance 21*b* of the eddy guiding structure 20*b* extends along the tangent of the eddy passage 13. The high pressure fluid flows into the eddy passage 13 tangentially through the guiding entrance 21*b*, flowing along the wall of the outer tube 11 and forming eddies. While passing the eddy passage 13, the high pressure fluid transfers heat with the working fluid in the fluid passage 121 of the inner tube 12*b*.

Figure 8:
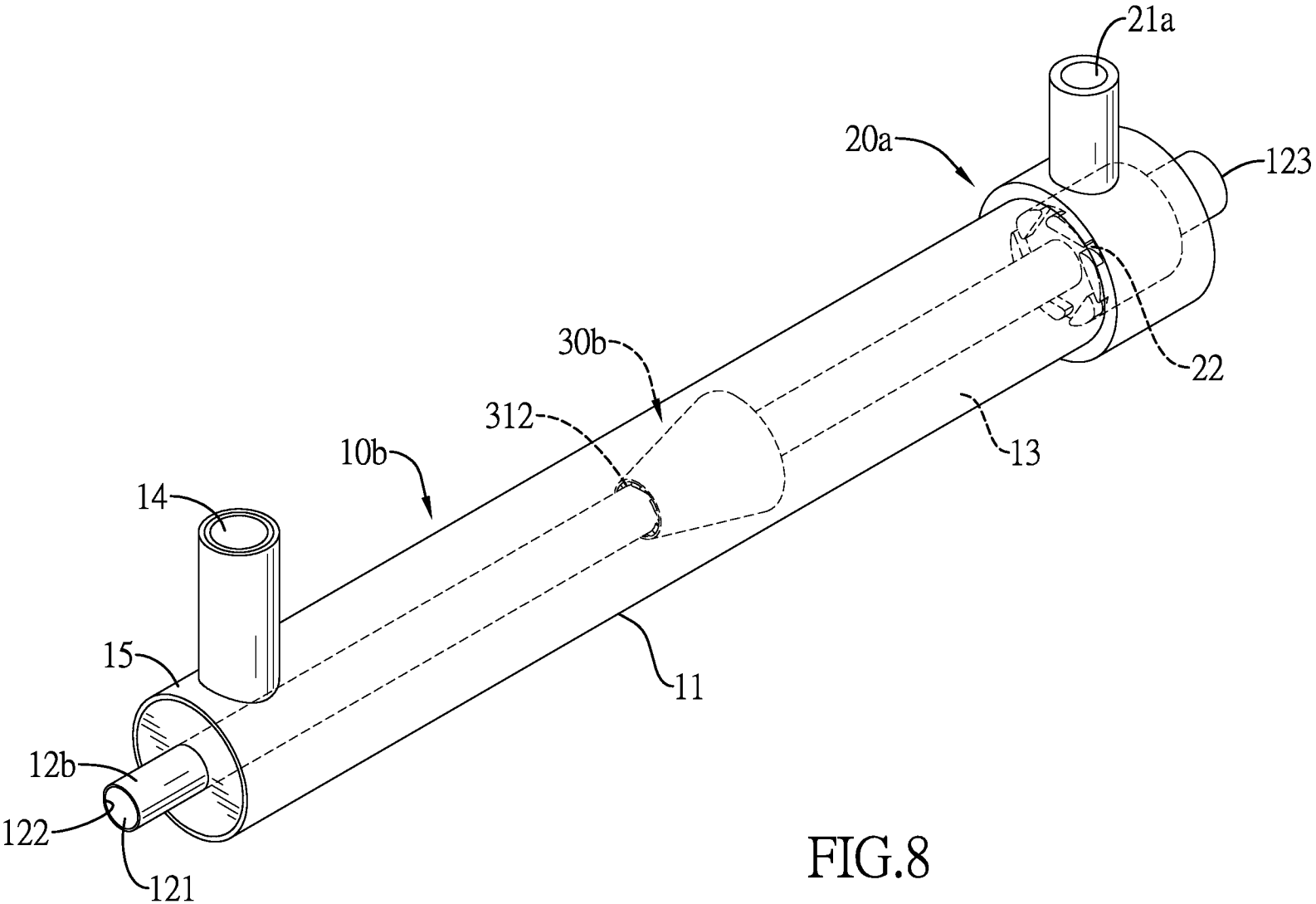
FIG. 8 is a perspective view of a third embodiment of the eddy fluid heat exchange device in accordance with the present invention.
Figure 9:
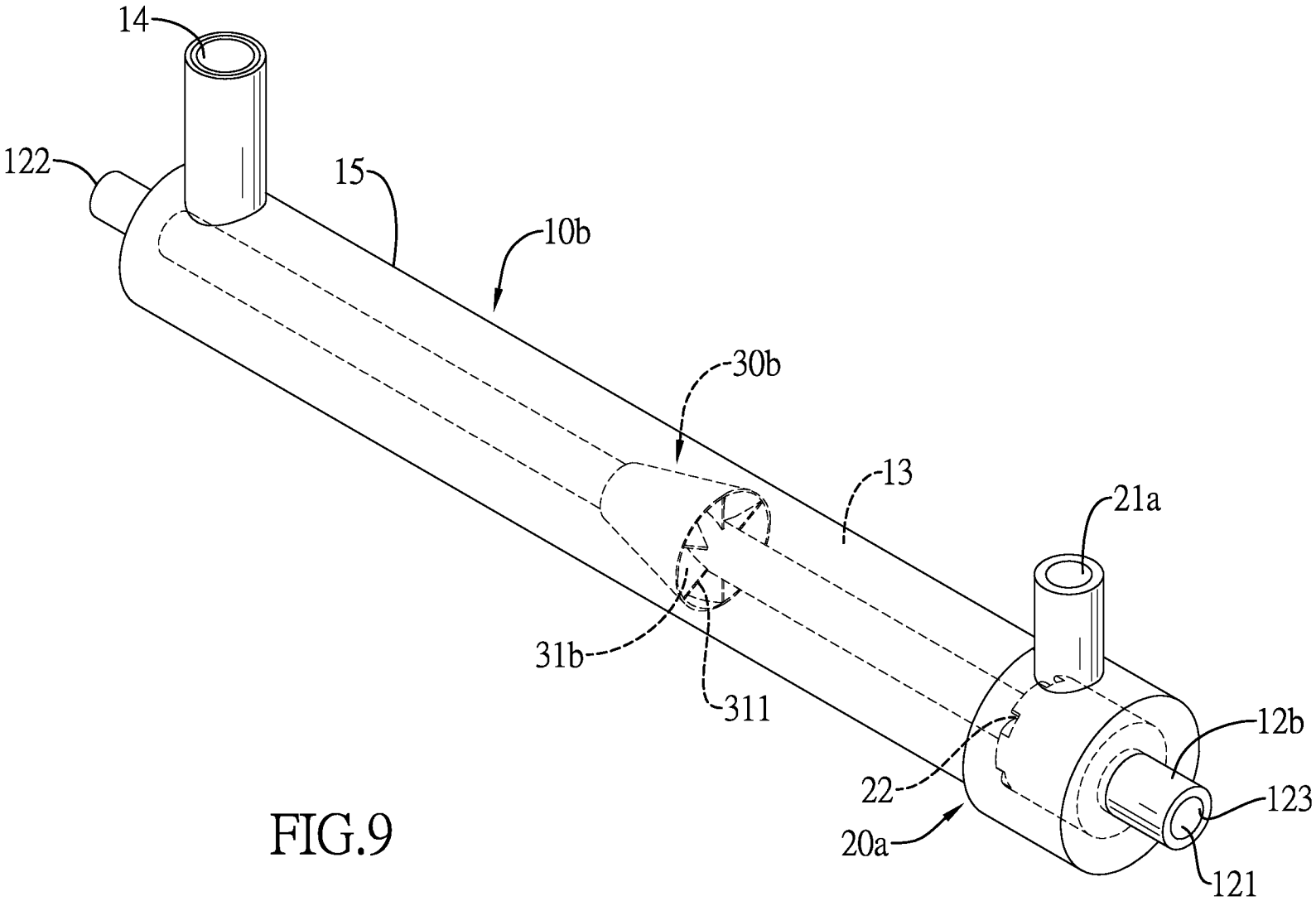
FIG. 9 is another perspective view of the third embodiment of the eddy fluid heat exchange device in FIG. 8.
Figure 10:
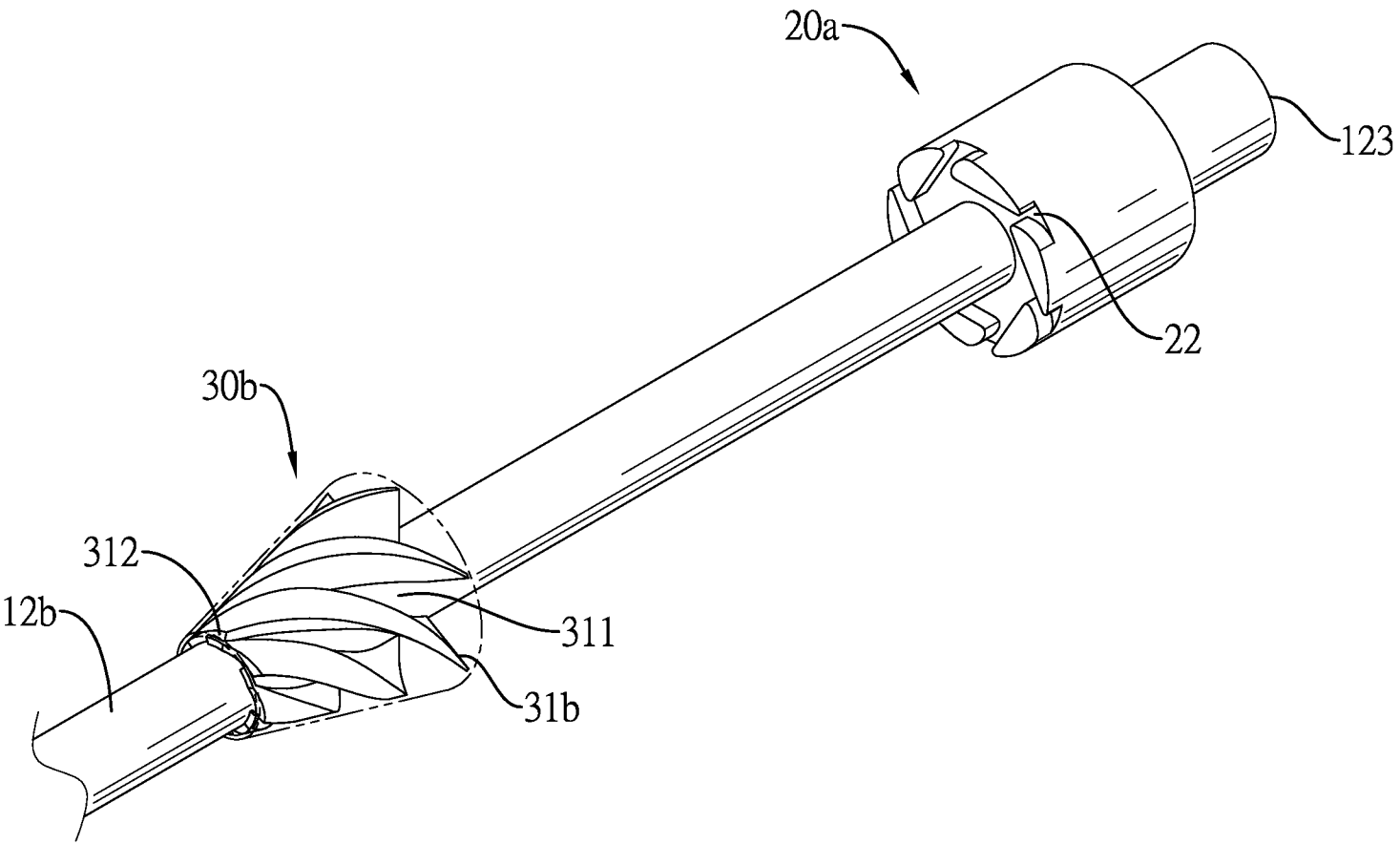
FIG. 10 is a perspective view of an eddy guiding structure, an inner tube and an eddy deflecting structure of the third embodiment of the eddy fluid heat exchange device in FIG. 8.

In addition, with reference to FIGS. 8, 10 and 15, the present invention comprises the at least one eddy deflecting structure 30*b* in the third and the fourth embodiments of the present invention. The outlet ends 312 of the multiple deflecting channels 31*b* of the eddy deflecting structure 30*b* are mounted near an outer wall of the inner tube 12*b*. While passing through the eddy deflecting structure 30*b*, the high pressure fluid flows along the multiple deflecting channels 31*b* and the outer wall of the inner tube 12*b* to improve the heat transfer efficiency between the high pressure fluid and the inner tube 12*b*.

Figure 16:
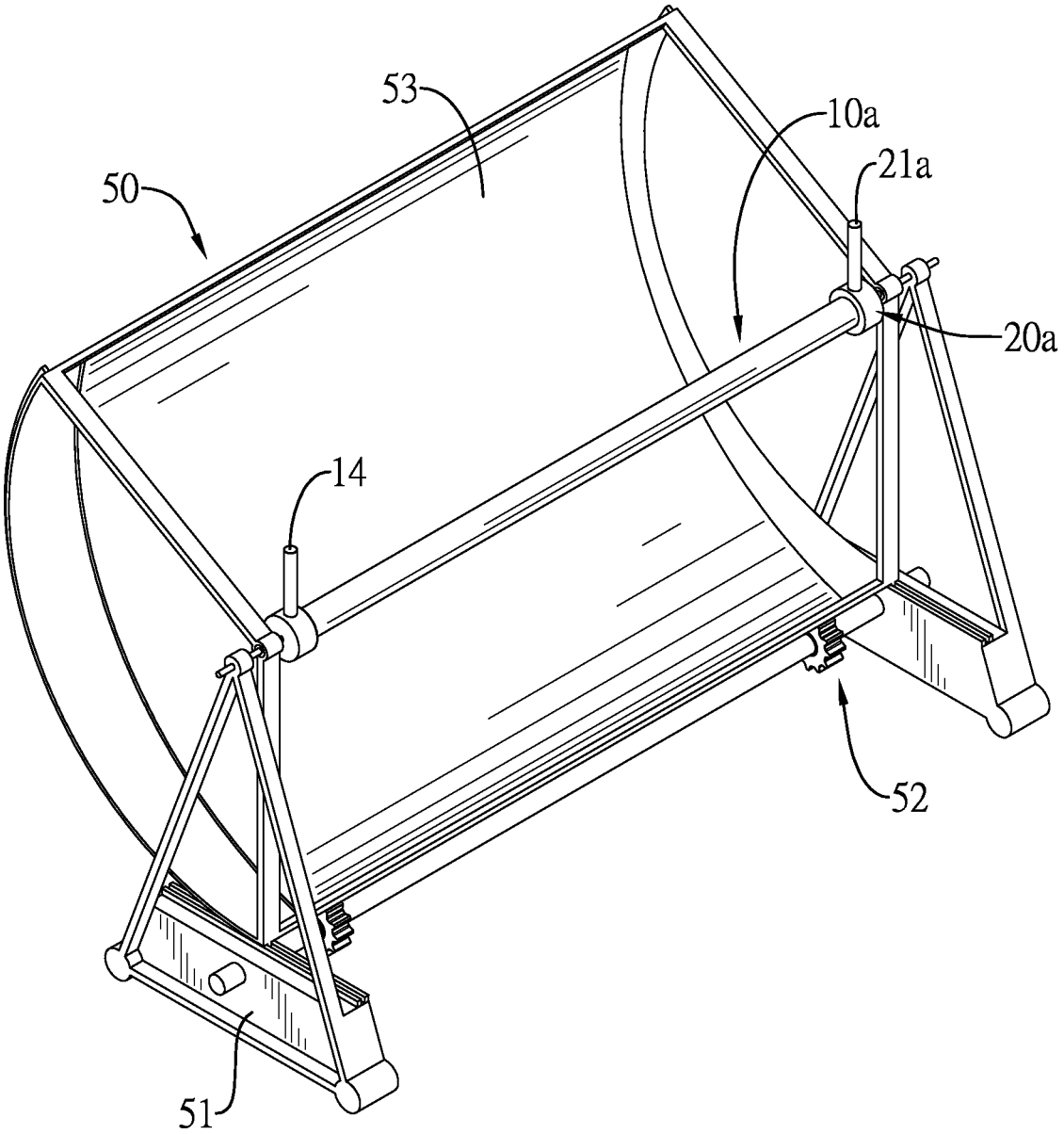
FIG. 16 is a perspective view of the present invention, applied in a solar thermal collector.
Figure 17:
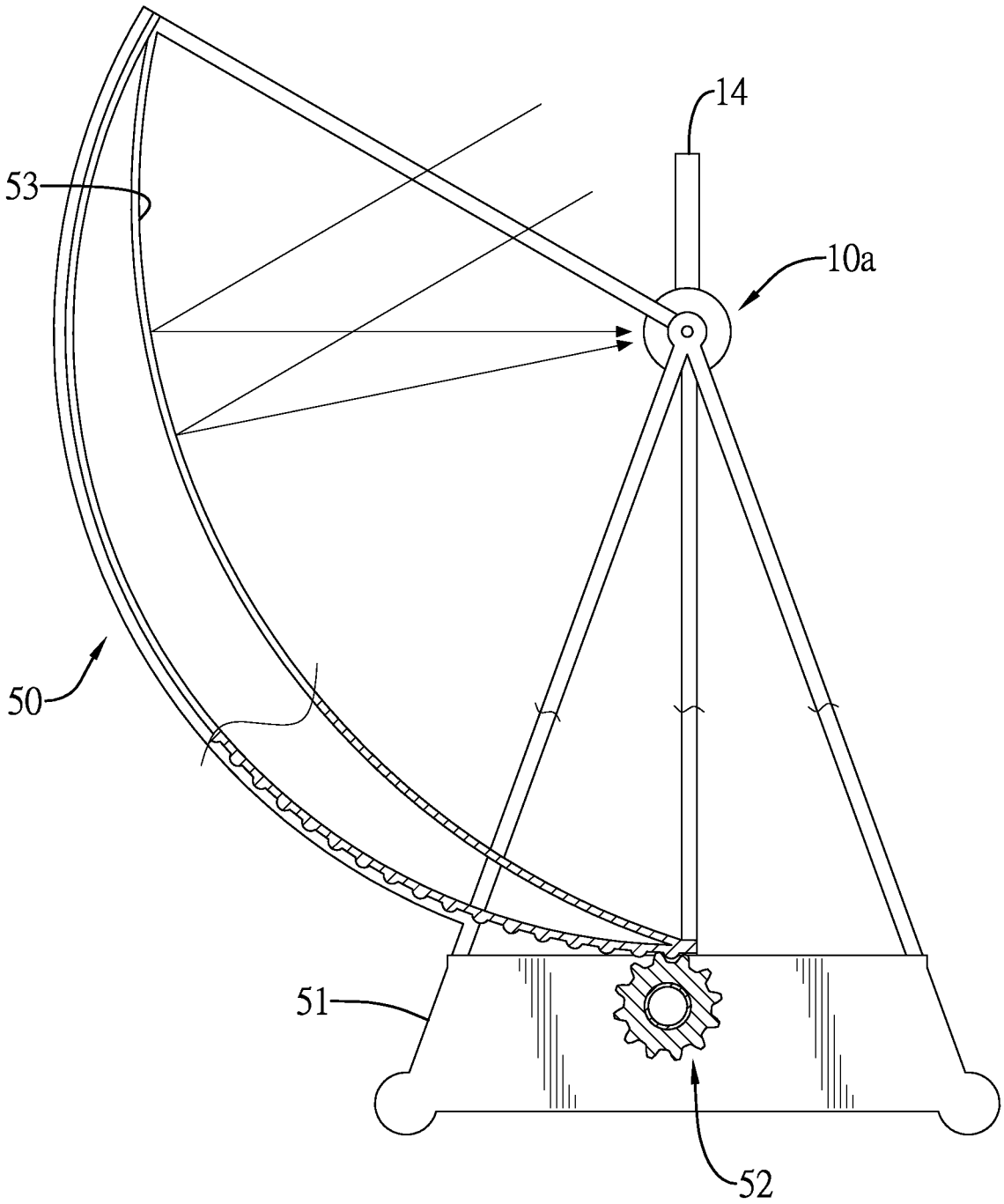
FIG. 17 is a perspective view of the solar thermal collector, collecting heat.
Figure 18:
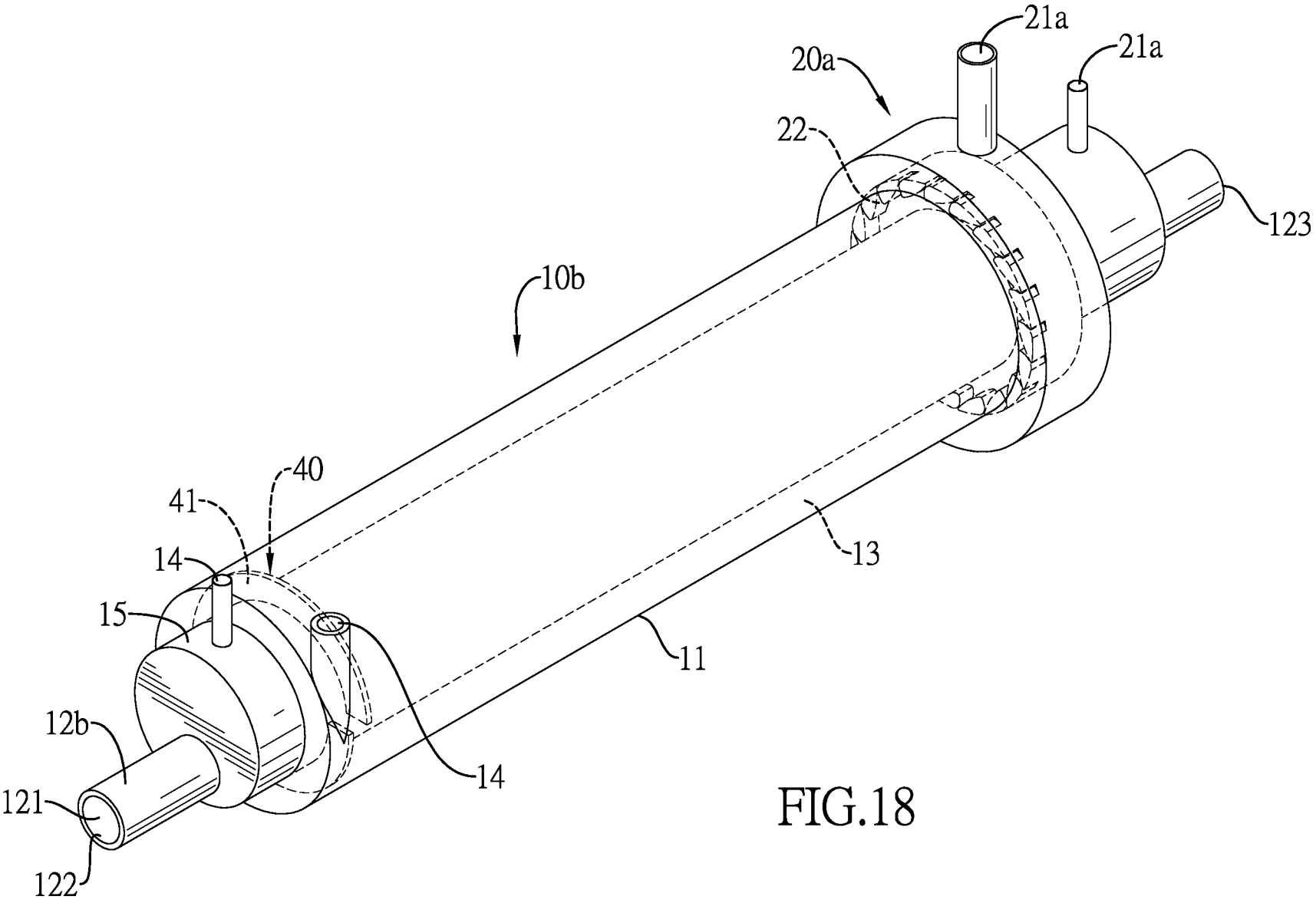
FIG. 18 is a perspective view of the eddy fluid heat exchange device in multiple embodiments.
Figure 19:
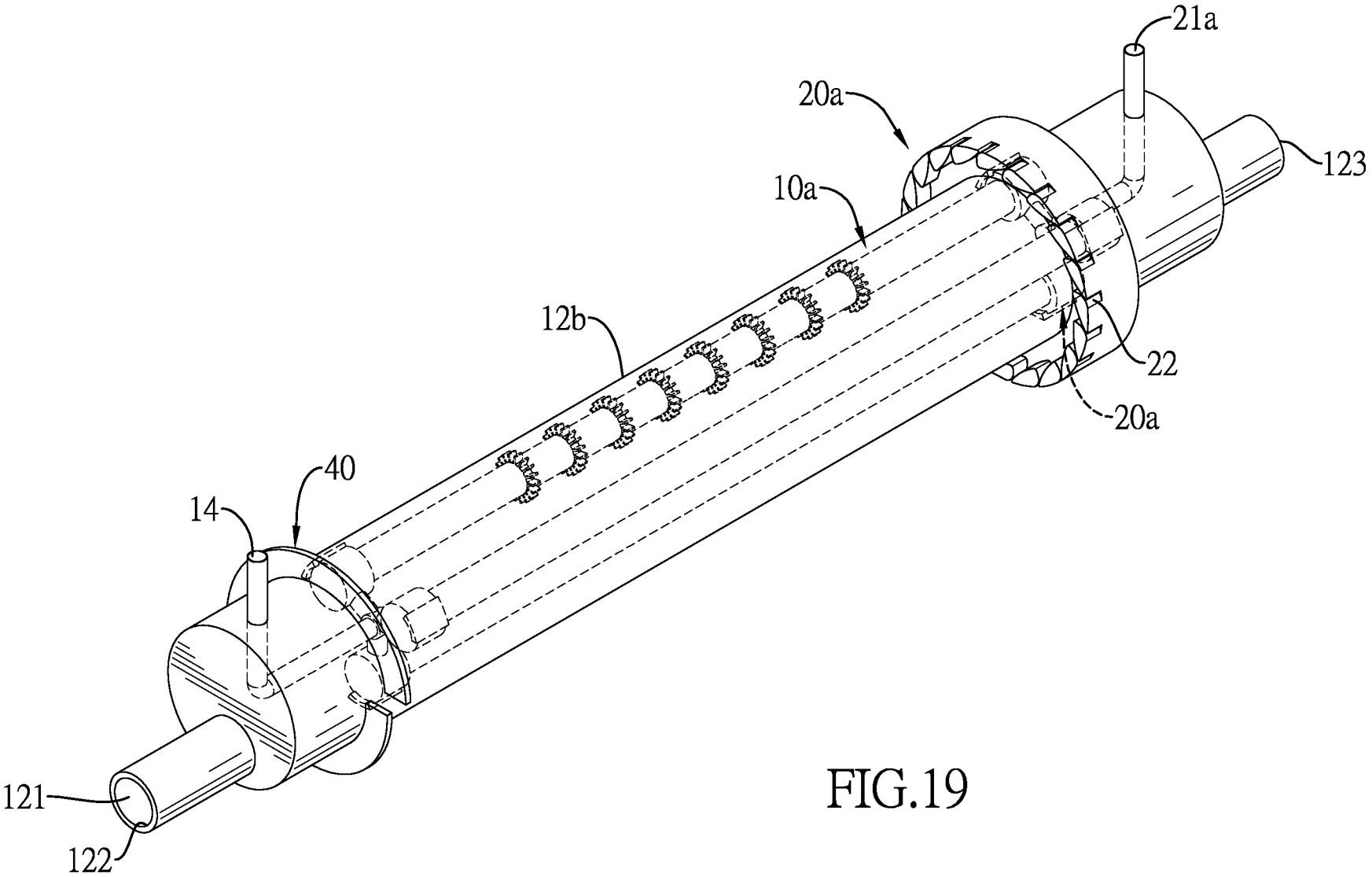
FIG. 19 is a perspective view of structures inside the eddy fluid heat exchange device in FIG. 18.
Figure 20:
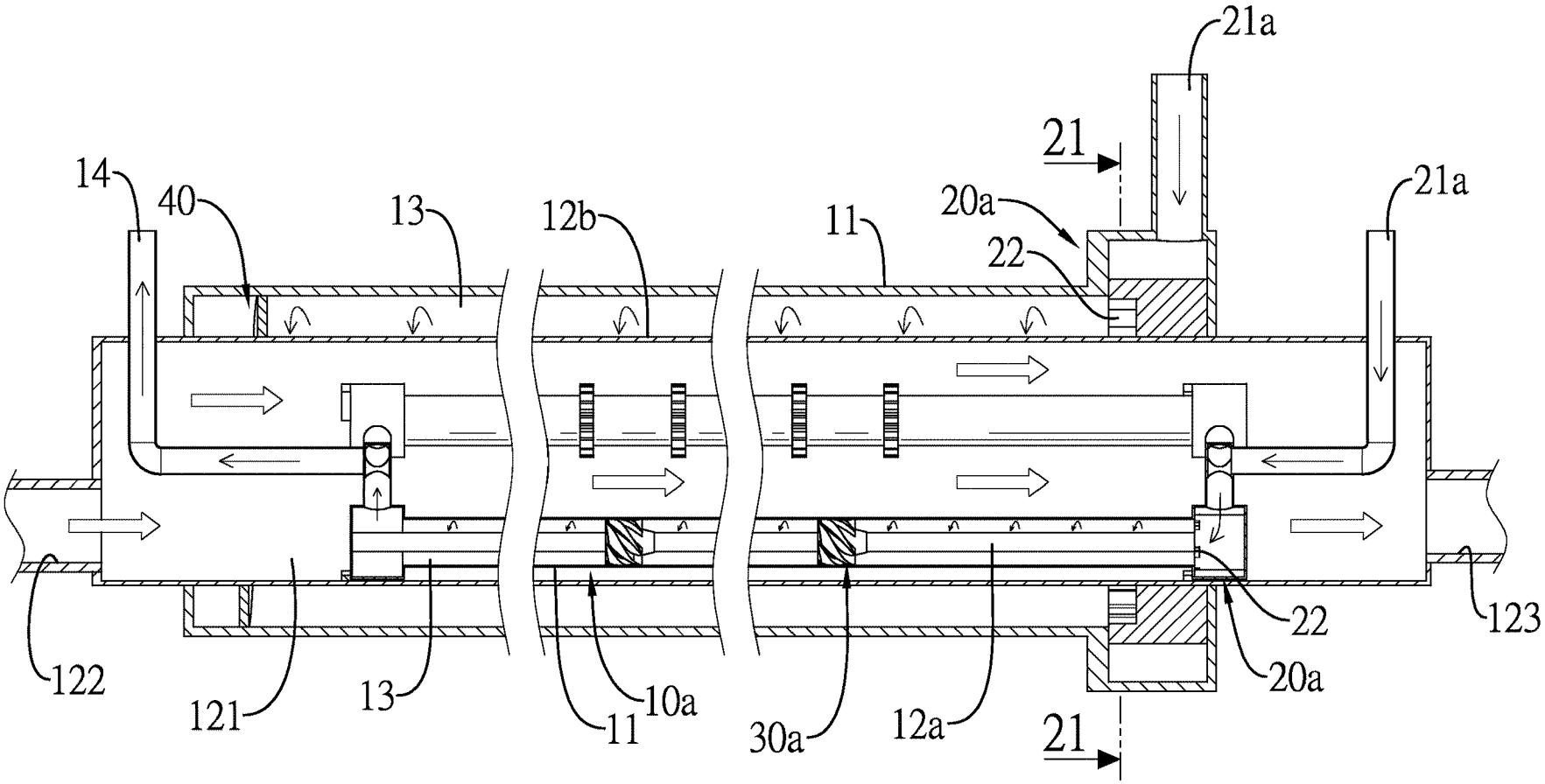
FIG. 20 is a side view of the eddy fluid heat exchange device in FIG. 18.
Figure 21:
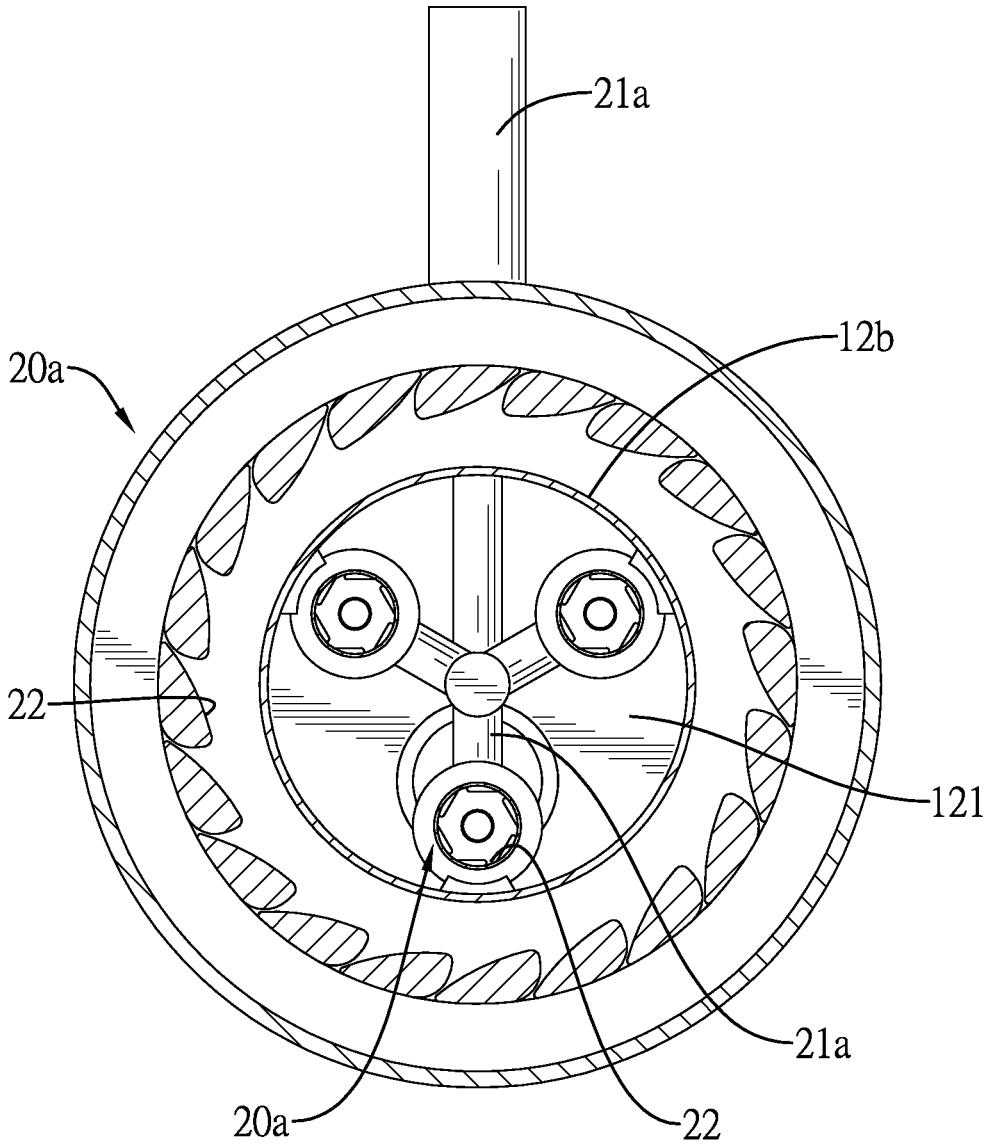
FIG. 21 is a partial sectional view across line 21-21 in FIG. 20.

The present invention has multiple applications. As shown in FIGS. 16 and 17, in the first embodiment of the present invention, the eddy fluid heat exchange device is applied in a solar thermal collector 50. The solar thermal collector 50 comprises a base 51, a solar tracker 52 and a light reflector 53. The solar tracker 52 is mounted on the base 51. The light reflector 53 is rotatably mounted on the base 51 by a shaft, controlled by and connected to the solar tracker 52. The present invention is mounted on the shaft between the base 51 and the light reflector 53. Driven by the solar tracker 52 to rotate relative to the base 51, the light reflector 53 maintains facing the moving sun to reflect sun light toward the outer tube 11 of the eddy fluid heat exchange device.

Heated by a radiation of the sun light, the high pressure fluid exchanges heat with the outer tube 11 while passing through the eddy passage 13. The high pressure fluid is discharged from the guiding exit 14 at a high temperature. Thus, a generator generates electricity by connecting to the present invention applied in the solar thermal collector 50.

The multiple embodiments of the present invention may be applied in and paired with each other. As shown in FIGS. 18 to 21, multiple first embodiments pair with one third embodiment of the present invention. The first embodiments are parallelly mounted inside the fluid passage 121 of the third embodiment. The high pressure fluid inside the first embodiments and the third embodiment exchanges heat with the working fluid inside the fluid passage 121 of the third embodiment to improve the heat transfer efficiency.

By the passage designs of the compound tube assembly 10*a*, 10*b* and the eddy guiding structure 20*a*, 20*b*, the high pressure fluid forms eddies surrounding the inner tube 12*a*, 12*b* when flowing through the eddy guiding structure 20*a*, 20*b*, thereby extending the flowing path of the high pressure fluid in the eddy passage 13. Thus, complex circuitous passages are unnecessary, simplifying the structures and lowering the costs of production and maintenance. Besides, increasing a heat transfer area between the high pressure fluid and the outer tube 11 or the inner tube 12*a*, 12*b* improves the heat transfer efficiency.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. An eddy fluid heat exchange device comprising:
- a compound tube assembly comprising
  - an outer tube;
  - an inner tube mounted in the outer tube;
  - an eddy passage formed between the outer tube and the inner tube and extending along an axis of the inner tube, the outer tube having
  - a guiding exit formed at an end of the eddy passage;
- an eddy guiding structure mounted at the compound tube assembly, disposed at another end, which is opposite to the guiding exit, of the eddy passage; the eddy guiding structure having
  - a guiding entrance connected to the eddy passage; and
- at least one eddy deflecting structure mounted in the eddy passage of the compound tube assembly, spaced apart from the eddy guiding structure, and having
  - a sleeve being conic;
  - multiple vanes annularly mounted on the sleeve; and
  - multiple spiral deflecting channels defined by and separated by the multiple vanes, with each adjacent pair of vanes of the multiple vanes defining therebetween one respective spiral deflecting channel of the multiple spiral deflecting channels; each one of the spiral deflecting channels having an inlet end and an outlet end both respectively connected to the eddy passage; wherein a bore of each one of the spiral deflecting channels gradually reduces in size from the inlet end to the outlet end;
- wherein a high pressure fluid is fed into the guiding entrance; after passing through the eddy guiding structure, the high pressure fluid eddies and enters the eddy passage; the high pressure fluid eddies when passing through the multiple spiral deflecting channels; and the high pressure fluid is discharged from the guiding exit after exchanging heat with the inner tube or the outer tube.

2. The eddy fluid heat exchange device as claimed in claim 1, wherein the eddy guiding structure has multiple spiral guiding channels; one end of each one of the guiding channels is connected to the eddy passage, and another end of each one of the guiding channels is connected to the guiding entrance; the high pressure fluid eddies when passing through the guiding channels.

3. The eddy fluid heat exchange device as claimed in claim 2, wherein
- an outer side of the outer tube is covered by an insulation layer; and
- the inner tube has
  - a fluid passage formed inside and having
    - a fluid inlet; and
    - a fluid outlet; working fluid is fed into the fluid passage through the fluid inlet to exchange heat with the high pressure fluid and is discharged from the fluid outlet.

4. The eddy fluid heat exchange device as claimed in claim 3, wherein the eddy fluid heat exchange device comprises at least one additional eddy deflecting structure mounted in the eddy passage of the compound tube assembly, spaced apart from the eddy guiding structure; and having multiple additional spiral deflecting channels annularly disposed apart from each other; two ends of each one of the additional spiral deflecting channels respectively being an inlet end and an outlet end; the inlet end and the outlet end both respectively connected to the eddy passage; a bore of each one of the additional spiral deflecting channels gradually reducing in size from the inlet end to the outlet end; the high pressure fluid eddies when passing through the multiple additional spiral deflecting channels.

5. The eddy fluid heat exchange device as claimed in claim 4, wherein the outlet end of each one of the multiple deflecting channels of the eddy deflecting structure is disposed adjacent to an outer wall of the inner tube.

6. The eddy fluid heat exchange device as claimed in claim 2, wherein the eddy fluid heat exchange device comprises at least one additional eddy deflecting structure mounted in the eddy passage of the compound tube assembly, spaced apart from the eddy guiding structure; and having multiple additional spiral deflecting channels annularly disposed apart from each other; two ends of each one of the additional spiral deflecting channels respectively being an inlet end and an outlet end; the inlet end and the outlet end both respectively connected to the eddy passage; a bore of each one of the additional spiral deflecting channels gradually reducing in size from the inlet end to the outlet end; the high pressure fluid eddies when passing through the multiple additional spiral deflecting channels.

7. The eddy fluid heat exchange device as claimed in claim 6, wherein the outlet end of each one of the multiple deflecting channels of the eddy deflecting structure is disposed adjacent to an inner wall of the outer tube.

8. The eddy fluid heat exchange device as claimed in claim 1, wherein the guiding entrance of the eddy guiding structure extends along a tangent of the eddy passage.

9. The eddy fluid heat exchange device as claimed in claim 8, wherein an outer side of the outer tube is covered by an insulation layer outside; and the inner tube has a fluid passage formed inside and having a fluid inlet; and a fluid outlet; working fluid is fed into the fluid passage through the fluid inlet to exchange heat with the high pressure fluid and is discharged from the fluid outlet.

10. The eddy fluid heat exchange device as claimed in claim 9, wherein the eddy fluid heat exchange device comprises at least one additional eddy deflecting structure mounted in the eddy passage of the compound tube assembly, spaced apart from the eddy guiding structure; and having multiple additional spiral deflecting channels annularly disposed apart from each other; two ends of each one of the additional spiral deflecting channels respectively being an inlet end and an outlet end; the inlet end and the outlet end both respectively connected to the eddy passage; a bore of each one of the additional spiral deflecting channels gradually reducing in size from the inlet end to the outlet end; the high pressure fluid eddies when passing through the multiple additional spiral deflecting channels.

11. The eddy fluid heat exchange device as claimed in claim 10, wherein the outlet end of each one of the multiple deflecting channels of the eddy deflecting structure is disposed adjacent to an outer wall of the inner tube.

12. The eddy fluid heat exchange device as claimed in claim 11, wherein the eddy fluid heat exchange device comprises a diversion plate mounted in the eddy passage of the compound tube assembly, disposed adjacent to the guiding exit of the outer tube, and having a spiral channel formed inside the diversion plate, connected to the eddy passage, and guiding the high pressure fluid out from the guiding exit.

13. The eddy fluid heat exchange device as claimed in claim 1, wherein an outer side of the outer tube is covered by an insulation layer; and the inner tube has a fluid passage formed inside and having a fluid inlet; and a fluid outlet;

working fluid is fed into the fluid passage through the fluid inlet to exchange heat with the high pressure fluid and is discharged from the fluid outlet.

14. The eddy fluid heat exchange device as claimed in claim 13, wherein the eddy fluid heat exchange device comprises at least one additional eddy deflecting structure mounted in the eddy passage of the compound tube assembly, spaced apart from the eddy guiding structure; and have multiple additional spiral deflecting channels annularly disposed apart from each other; two ends of each one of the additional spiral deflecting channels respectively being an inlet end and an outlet end; the inlet end and the outlet end both respectively connected to the eddy passage; a bore of each one of the additional spiral deflecting channels gradually reducing in size from the inlet end to the outlet end; the high pressure fluid eddies when passing through the multiple additional spiral deflecting channels.

15. The eddy fluid heat exchange device as claimed in claim 14, wherein the outlet end of each one of the multiple deflecting channels of the eddy deflecting structure is disposed adjacent to an outer wall of the inner tube.

16. The eddy fluid heat exchange device as claimed in claim 1, wherein the outlet end of each one of the multiple deflecting channels of the eddy deflecting structure is disposed adjacent to an inner wall of the outer tube.

17. The eddy fluid heat exchange device as claimed in claim 1, wherein the eddy fluid heat exchange device comprises a diversion plate mounted in the eddy passage of the compound tube assembly, disposed adjacent to the guiding exit of the outer tube, and having a spiral channel formed inside the diversion plate, connected to the eddy passage, and guiding the high pressure fluid out from the guiding exit.

* * * * *